US008113636B2

(12) United States Patent
Nishida et al.

(10) Patent No.: US 8,113,636 B2
(45) Date of Patent: Feb. 14, 2012

(54) INKJET HEAD AND INKJET RECORDING APPARATUS

(75) Inventors: Hideaki Nishida, Izunokuni (JP); Noboru Nitta, Tagata-gun (JP); Isao Suzuki, Mishima (JP); Masashi Shimosato, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 887 days.

(21) Appl. No.: 12/170,600

(22) Filed: Jul. 10, 2008

(65) Prior Publication Data

US 2009/0015640 A1 Jan. 15, 2009

(30) Foreign Application Priority Data

Jul. 13, 2007 (JP) ..... 2007-184480

(51) Int. Cl.
*B41J 2/175* (2006.01)

(52) U.S. Cl. ..... 347/85; 347/68; 347/69; 347/70; 347/71; 347/72; 347/84; 347/86; 347/87; 347/88; 347/89; 347/90

(58) Field of Classification Search ..... 347/68–72, 347/84–90

See application file for complete search history.

(56) References Cited

U.S. PATENT DOCUMENTS 5,231,424 A * 7/1993 Kaneko et al. ..... 347/29
7,083,253 B2 * 8/2006 Kimura et al. ..... 347/29
7,128,406 B2 10/2006 Dixon et al.
7,695,103 B2 * 4/2010 Nagashima ..... 347/40
7,878,632 B2 * 2/2011 Kachi ..... 347/84
2005/0117003 A1 * 6/2005 Kyogoku et al. ..... 347/86
2006/0001714 A1 * 1/2006 Usui et al. ..... 347/86
2006/0209138 A1 * 9/2006 Kachi ..... 347/68
2008/0158307 A1 * 7/2008 Nitta et al. ..... 347/85
2008/0158320 A1 * 7/2008 Nitta et al. ..... 347/89
2008/0158321 A1 * 7/2008 Nitta et al. ..... 347/89
2008/0297549 A1 * 12/2008 Nitta et al. ..... 347/12

* cited by examiner

*Primary Examiner* — Ryan Lepisto
*Assistant Examiner* — Guy Anderson
(74) *Attorney, Agent, or Firm* — Turocy & Watson, LLP

(57) ABSTRACT

An inkjet head includes a nozzle to discharge liquid droplets, a pressure chamber which is configured to communicate with the nozzle and filled with liquid, a supply section which is configured to communicate with the pressure chamber and supplies the liquid to the pressure chamber, a recovery section which is configured to communicate with the pressure chamber and recovers the liquid from the pressure chamber, a bypass channel which is independent of the pressure chamber and connects the supply section with the recovery section, a pressure-control liquid chamber which is connected at one end to the bypass channel and connected at the other end to the atmosphere, and a porous member which is contained inside the pressure-control liquid chamber.

15 Claims, 4 Drawing Sheets

INKJET HEAD AND INKJET RECORDING APPARATUS

CROSS-REFERENCE TO RELATED APPLICATIONS

This application is based upon and claims the benefit of priority from prior Japanese Patent Application No. 2007-184480, filed Jul. 13, 2007, the entire contents of which are incorporated herein by reference.

BACKGROUND OF THE INVENTION

1. Field of the Invention

The present invention relates to an inkjet head and an inkjet recording apparatus, which can maintain a constant pressure in the vicinity of nozzles.

2. Description of the Related Art

For example, PCT National Pub. No. 2002-533247 discloses the following, as an inkjet head with the pressure loss improved. The inkjet head comprises nozzles, an inlet manifold, an outlet manifold, and an array of fluid chambers connected to the manifolds. The inkjet head further comprises a member for generating fluid flows running through the inlet manifold and the chambers in the array into the outlet manifold.

In the inkjet head, fluid flows running through the chambers sufficiently prevent foreign matters in the fluid from remaining in the nozzles. In the meantime, demand for such ink-circulating inkjet heads has increased as being highly-reliable inkjet heads, because of high cleanliness of ink channels thereof.

However, in ink-circulating inkjet heads, the pressure in the vicinity of nozzles varies by influence of the length of the pipes of the ink channels and the diameter of the ink channels. Further, to prevent variations in ink discharge, it is necessary to keep a constant pressure in the vicinity of the nozzles. To control the pressure in the vicinity of the nozzles to a constant value in the above conventional inkjet head, it is necessary to adjust the channel resistance of the ink channels, and adjust the pressure of the ink tank. According to these methods, high accuracy is required in adjustment of the channel resistance and adjustment of the tank pressure, and there is room for improvement.

BRIEF SUMMARY OF THE INVENTION

An object of the present invention is to provide an inkjet head which can control the pressure in the vicinity of the nozzles to a constant value with a simple structure.

Another object of the present invention is to provide an inkjet recording apparatus which can control the pressure in the vicinity of the nozzles to a constant value with a simple structure.

To achieve the above object, an inkjet head according to an aspect of the present invention comprises: a nozzle to discharge liquid droplets; a pressure chamber which is configured to communicate with the nozzle and filled with liquid; a supply section which is configured to communicate with the pressure chamber and supplies the liquid to the pressure chamber; a recovery section which is configured to communicate with the pressure chamber and recovers the liquid from the pressure chamber; a bypass channel which is independent of the pressure chamber and connects the supply section with the recovery section; a pressure-control liquid chamber which is connected at one end to the bypass channel and connected at the other end to the atmosphere; and a porous member which is contained inside the pressure-control liquid chamber.

To achieve the above object, an inkjet head according to another aspect of the present invention comprises: a nozzle to discharge liquid droplets; a pressure chamber which is configured to communicate with the nozzle and filled with liquid; a supply section which is configured to communicate with the pressure chamber and supplies the liquid to the pressure chamber; a recovery section which is configured to communicate with the pressure chamber and recovers the liquid from the pressure chamber; a pressure-control liquid chamber which is connected at one end to the supply section and the recovery section and connected at the other end to the atmosphere; a porous member which is contained inside the pressure-control liquid chamber; a first communicating channel which connects the supply section with the pressure-control liquid chamber; and a second communicating channel which connects the recovery section with the pressure-control liquid chamber, wherein channel resistance from the nozzle to the first communicating channel is equal to channel resistance from the nozzle to the second communicating channel.

To achieve the above object, an inkjet recording apparatus according to an aspect of the present invention comprises: an inkjet head; a tank to supply liquid to the inkjet head; and a circulation mechanism which circulates the liquid between the inkjet head and the tank, wherein the inkjet head includes: a nozzle to discharge liquid droplets; a pressure chamber which is configured to communicate with the nozzle and filled with the liquid; a supply section which is configured to communicate with the pressure chamber and supplies the liquid to the pressure chamber; a recovery section which is configured to communicate with the pressure chamber and recovers the liquid from the pressure chamber; a bypass channel which is independent of the pressure chamber and connects the supply section with the recovery section; a pressure-control liquid chamber which is connected at one end to the bypass channel and connected at the other end to the atmosphere; and a porous member which is contained inside the pressure-control liquid chamber.

To achieve the above object, an inkjet recording apparatus according to another aspect of the present invention comprises: an inkjet head; a tank to supply liquid to the inkjet head; and a circulation mechanism which circulates the liquid between the inkjet head and the tank, wherein the inkjet head includes: a nozzle to discharge liquid droplets; a pressure chamber which is configured to communicate with the nozzle and filled with the liquid; a supply section which is configured to communicate with the pressure chamber and supplies the liquid to the pressure chamber; a recovery section which is configured to communicate with the pressure chamber and recovers the liquid from the pressure chamber; a pressure-control liquid chamber which is connected at one end to the supply section and the recovery section and connected at the other end to the atmosphere; a porous member which is contained inside the pressure-control liquid chamber; a first communicating channel which connects the supply section with the pressure-control liquid chamber; and a second communicating channel which connects the recovery section with the pressure-control liquid chamber, and channel resistance from the nozzle to the first communicating channel is equal to channel resistance from the nozzle to the second communicating channel.

According to the present invention, it is possible to provide an inkjet head which can control the pressure in the vicinity of the nozzles to a constant value with a simple structure.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of an inkjet recording apparatus according to the present invention will be described below with reference to drawings.

Figure 1:
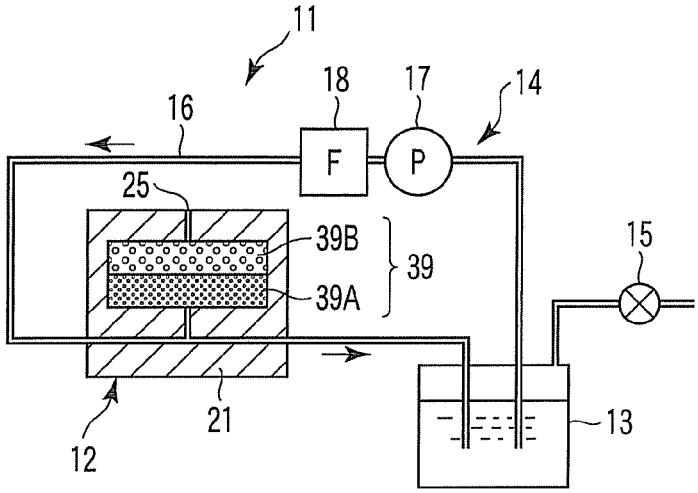
FIG. 1 is a schematic diagram illustrating an inkjet recording apparatus according to a first embodiment.

As illustrated in FIG. 1, an inkjet recording apparatus 11 comprises an inkjet head 12 which discharges liquid droplets to sheet-like recording media, a tank 13 to supply liquid to the inkjet head 12, and a circulation mechanism 14 which circulates the liquid between the inkjet head 12 and the tank 13. The tank 13 stores liquid inside. The liquid is formed of ink (pigment ink) or the like which can form characters and images on sheet-like recording media. The tank 13 has an air release valve 15, and can set the internal pressure to the atmospheric pressure by opening the air release valve 15, and change the internal pressure from the atmospheric pressure by closing the air release valve 15.

The circulation mechanism 14 has a circulating channel 16 having an annular shape, a pump 17 which is provided at a given point inside the circulating channel 16 and circulates a liquid in the circulating channel in the direction indicated by an arrow, and a filter member 18 provided at the given point in the circulating channel 16. Foreign matters mixed in the liquid can be collected by the filter member 18.

Figure 2:
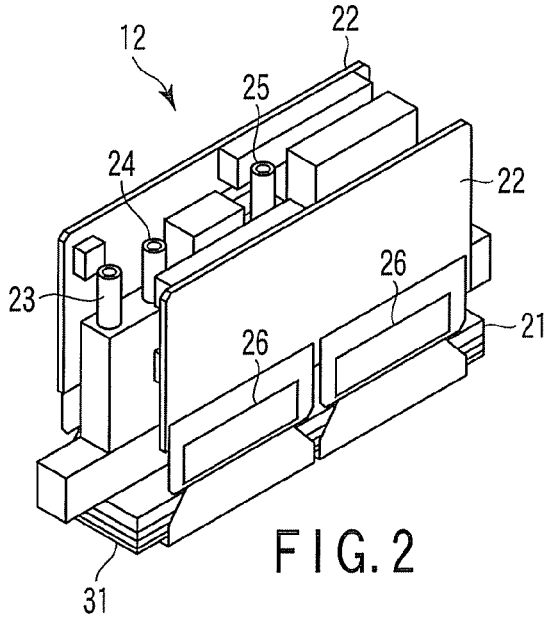
FIG. 2 is a perspective view of an inkjet head illustrated in FIG. 1.

As illustrated in FIG. 2, the inkjet head 12 has a head main body 21, a pair of circuit boards 22 attached to the head main body 21, a supply port 23 to supply the liquid to the head main body 21, a recovery port 24 which recovers the liquid from the head main body 21, and an air release port 25 which is connected to the head main body 21. Each circuit board 22 has head drive ICs 26. The supply port 23 and the recovery port 24 are connected to the circulating channel 16.

Figure 3:
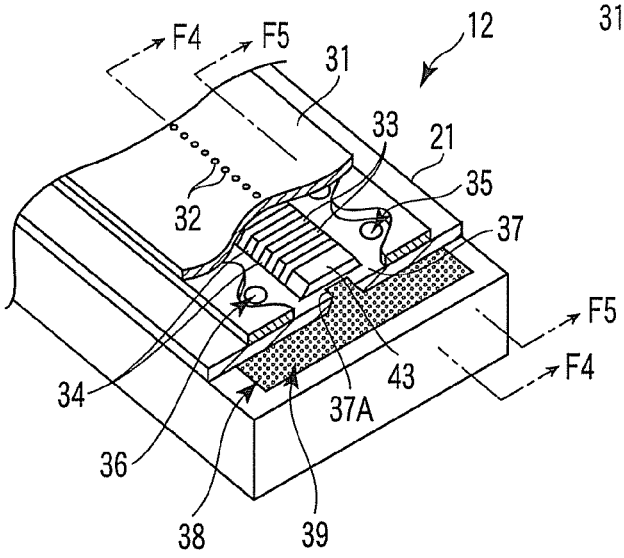
FIG. 3 is a perspective view of a head main body of the inkjet head illustrated in FIG. 2.

FIG. 3 is a perspective view of an internal portion of the head main body 21, with part of the head main body 21 cut away. As illustrated in FIG. 3, the head main body 21 has a nozzle plate 31, a plurality of nozzles 32 formed in the nozzle plate 31, pressure chambers 33 corresponding to the respective nozzles 32, drive elements 34 which are arranged on both sides of each pressure chamber 33 and hold each pressure chamber 33 therebetween, a supply channel 35 and a recovery channel 36 which communicate with the pressure chambers 33, a bypass channel 37 which is independent of the pressure chambers 33 and connects the supply channel 35 with the recovery channel 36, a pressure-control liquid chamber 38 which is connected at one end to the bypass channel 37 and opened at the other end to the atmosphere, and a porous member 39 which is contained inside the pressure-control liquid chamber 38.

The nozzles 32 are formed in a line on the nozzle plate 31. Each nozzle 32 can discharge liquid droplets. The pressure chambers 33 are formed of a plurality of groove portions formed in a piezoelectric member 43. The pressure chambers 33 are configured to communicate with the respective nozzles 32, and to be filled with the liquid. The piezoelectric member 43 is formed by bonding two piezoelectric element plates made of lead zirconium titanate (PZT). The two plates are bonded such that their polarization directions are opposite to each other. The drive elements 34 are formed of columns configured to be adjacent to both sides of each pressure chamber 33.

When the inkjet recording apparatus 11 receives instruction from the user to start printing in the state where the pressure chamber 33 is filled with a liquid, a control section (not shown) of the inkjet recording apparatus 11 outputs a printing signal for the inkjet head 12 to the head drive ICs 26. The head drive ICs 26 which have received the printing signal apply a drive pulse voltage to the drive elements 34. Thereby, a pair of drive elements 34 perform share mode deformation and are curved away from each other. Then, the drive elements 34 are returned to the original positions to pressurize the liquid in the corresponding pressure chamber 33 held between the drive elements 34, and thereby liquid droplets are ejected from the relevant nozzle 32.

Figure 5:
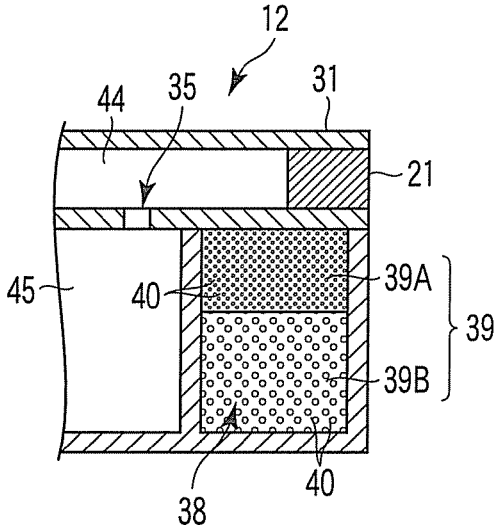
FIG. 5 is a cross-sectional view of the head main body illustrated in FIG. 3, taken along line F5-F5 of FIG. 3.

As illustrated in FIG. 5, the supply channel 35 is connected to the pressure chambers 33 through a shared liquid chamber 44. The supply channel 35 is also connected to the supply port 23 through a rectifier section 45. The supply channel 35 can supply the liquid to the pressure chambers 33. The recovery channel 36 is connected to the recovery port 24, and can recover the liquid from the pressure chambers 33. The term "supply section" in the claims indicates a concept including the supply port 23 and the supply channel 35. The term "recovery section" in the claims indicates a concept including the recovery port 24 and the recovery channel 36.

Figure 4:
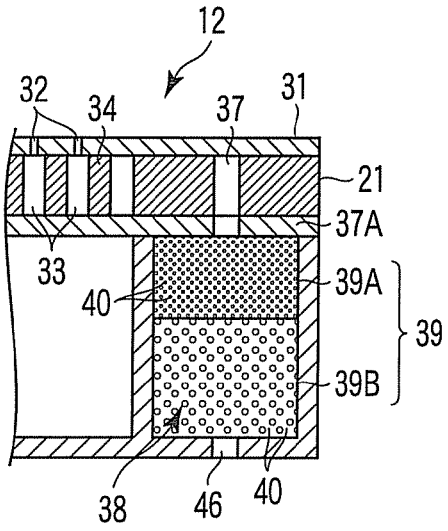
FIG. 4 is a cross-sectional view of the head main body illustrated in FIG. 3, taken along line F4-F4 of FIG. 3.

As illustrated in FIG. 3, the bypass channel 37 is provided independent of the pressure chambers 33, in a position close to the end portion of inkjet head 12. An opening portion 37A is formed at a given point inside the bypass channel 37, and the bypass channel 37 communicates with the pressure-control liquid chamber 38 through the opening portion 37A. As illustrated in FIG. 4, the pressure-control liquid chamber 38 has an air release hole 46, and thereby the internal portion of the pressure-control liquid chamber 38 is opened to the atmosphere. The air release hole 46 is connected to the air release port 25.

The porous member 39 is a spongy member which can absorb liquid and hold the liquid therein. The porous member 39 is formed of polyurethane foam or the like. The porous member 39 has a plurality of minute holes 40, which communicate with each other. The porous member 39 exhibits a capillary phenomenon for liquid. The material of the porous member 39 is not limited to the above, but the porous member 39 may be formed of a laminated fiber structure made of a thermoplastic resin.

As illustrated in FIG. 4, the porous member 39 has a first portion 39A which is densely formed, and a second portion 39B which is sparsely formed. The first portion 39A is disposed in a position adjacent to the bypass channel 37. The second portion 39B is disposed in a position adjacent to the air release hole 46. As illustrated in FIG. 1, the first portion 39A is disposed under the second portion 39B. The intensity of the capillary action is inversely proportional to the inside diameter of the pipe. Therefore, for example, when the density of the porous member 39 increases and the inside diameter of the pipe is narrowed as in the first portion 39A, the capillary action of the first portion 39A is larger than that of the second portion 39B.

To use the inkjet recording apparatus 11 having the above structure, first, the pump 17 is driven in the state where the air release valve 15 of the tank 13 is opened, and thereby the inkjet head 12 is filled with the liquid. Then, when a certain volume of liquid is filled in the porous member 39 in the pressure-control liquid chamber 38, filling of the liquid is stopped. In this state, the capillary action of the porous member 39 influences the pressure chambers 33, and the pressure of the pressure chambers 33 is controlled to a weak negative pressure.

More specifically, when the capillary action of the porous member 39 influences the liquid, the liquid is drawn up and rises. The liquid stops at a position where the pressure of meniscuses of the nozzles 32 balances the capillary action. In the inkjet head 12, the liquid is opened to the atmosphere in the nozzles 32 and the porous member 39. When the liquid rises under the capillary action, meniscuses of the nozzles 32 recede upward. Specifically, the pressure in the vicinity of the nozzles 32 is maintained at a negative pressure, which is lower than the atmospheric pressure.

Next, after the air release valve 15 is closed, the pump 17 is driven to circulate the liquid through the circulating channel 16. Also in this state where the liquid is circulated, the pressure chambers 33 in the vicinity of the nozzles 32 is maintained at a weak negative pressure by the capillary action of the porous member 39.

Specifically, when the pressure in the inkjet head 12 is about to fall, the amount of the liquid maintained inside the porous member 39 is reduced. In this case, the liquid level of the liquid impregnated in the porous member 39 lowers, and the liquid is maintained only by the dense first portion 39A of the porous member 39. In this state, the porous member 39 exhibits an intense capillary action, and functions to draw the liquid from the tank 13 and the circulating channel 16 into the porous member 39. Thereby, an exhaustion of the liquid in the inkjet head 12 is prevented, and the pressure in the inkjet head 12 is maintained at a constant weak negative pressure.

In addition, when the pressure in the inkjet head 12 is about to rise, the amount of the liquid impregnated into the porous member 39 increases, and the liquid level of the liquid rises. In this case, the liquid level of the liquid reaches the sparse second portion 39B. In this state, the porous member 39 exhibits a weak capillary action. As a result, the amount of the liquid drawn from the tank 13 and the circulating channel 16 into the inkjet head 12 is reduced, and the pressure in the inkjet head 12 can be maintained at a constant weak pressure.

According to the first embodiment described above, the inkjet recording apparatus 11 has the inkjet head 12, the tank 13 to supply the liquid to the inkjet head 12, and the circulation mechanism 14 which circulates the liquid between the inkjet head 12 and the tank 13. The inkjet head 12 has the nozzles 32 to discharge liquid droplets, the pressure chambers 33 which are configured to communicate with the respective nozzles 32 and filled with the liquid, the supply channel 35 which is configured to communicate with the pressure chambers 33 and supplies the liquid to the pressure chambers 33, the recovery channel 36 which is configured to communicate with the pressure chambers 33 and recovers the liquid from the pressure chambers 33, the bypass channel 37 which is independent of the pressure chambers 33 and connects the supply channel 35 with the recovery channel 36, the pressure-control liquid chamber 38 which is connected at one end to the bypass channel 37 and opened at the other end to the atmosphere, and the porous member 39 which is contained inside the pressure-control liquid chamber 38.

According to the above structure, since the inkjet head 12 has the pressure-control liquid chamber 38 opened to the atmosphere, it is possible to maintain the inside of the inkjet head 12 at almost the atmospheric pressure. In addition, since the porous member 39 is disposed inside the pressure-control liquid chamber 38, it is possible to cause capillary action to influence the liquid. Thereby, the liquid is drawn upward to cause the meniscuses of the nozzles 32 to recede, and the pressure in the vicinity of the nozzles 32 can be maintained at a weak negative pressure lower than the atmospheric pressure. Therefore, it is possible to maintain a suitable pressure for liquid discharge in the vicinity of the nozzles 32 of the inkjet head 12, regardless of the length of the pipe of the circulating channel 16, the diameter of the circulating channel 16, and the pressure of the tank 13.

In this case, the porous member 39 has the first portion 39A which is densely formed, and the second portion 39B which is sparsely formed, and the first portion 39A is disposed under the second portion 39B. According to this structure, when the liquid is scarce in the inkjet head 12 and the pressure is about to fall, the liquid level of the liquid in the pressure-control liquid chamber 38 lowers, and the liquid is impregnated and held only in the first portion 39. Therefore, an intense capillary action influences the liquid, and the liquid is drawn from the tank 13 and the circulating channel 16 into the inkjet head 12. This prevents scarcity of the liquid in the inkjet head 12.

On the other hand, when the liquid in the inkjet head 12 increases and the pressure is about to rise, the liquid level of the liquid in the pressure-control liquid chamber 38 rises, and the liquid is impregnated and held in both the first portion 39A and the second portion 39B of the porous member 39. In this case, a weak capillary action influences the liquid in the pressure-control liquid chamber 38, and thus the amount of the liquid drawn from the tank 13 and the circulating channel 16 into the inkjet head 12 is reduced. This prevents supply of a large amount of liquid to the inkjet head 12, and rise of the pressure in the inkjet head 12.

Next, a second embodiment including an inkjet recording apparatus 51 is explained below with reference to FIGS. 6 and 9. Although the inkjet recording apparatus 51 of the second embodiment is different from the first embodiment in the structure of an inkjet head 52, the other constituent elements thereof are the same as those of the first embodiment. Therefore, constituent elements which are different from the first embodiment are mainly explained, and the same constituent elements as the first embodiment are denoted by the same respective reference numbers and not explained in the second embodiment.

The inkjet head 52 has a head main body 21, a pair of circuit boards 22 attached to the head main body 22, a supply port 23 to supply liquid to the head main body 21, a recovery port 24 to recover the liquid from the head main body 21, and an air release port 25 connected to the head main body 21.

Figure 6:
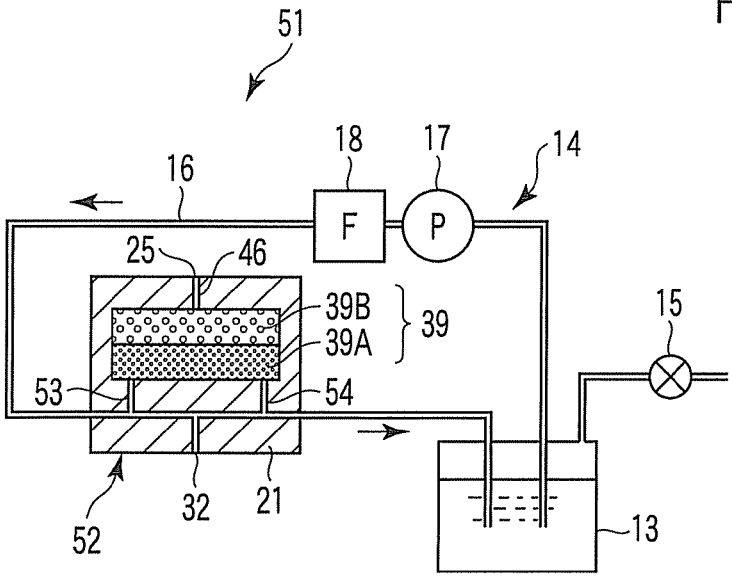
FIG. 6 is a schematic diagram of an inkjet recording apparatus according to a second embodiment.
Figure 7:
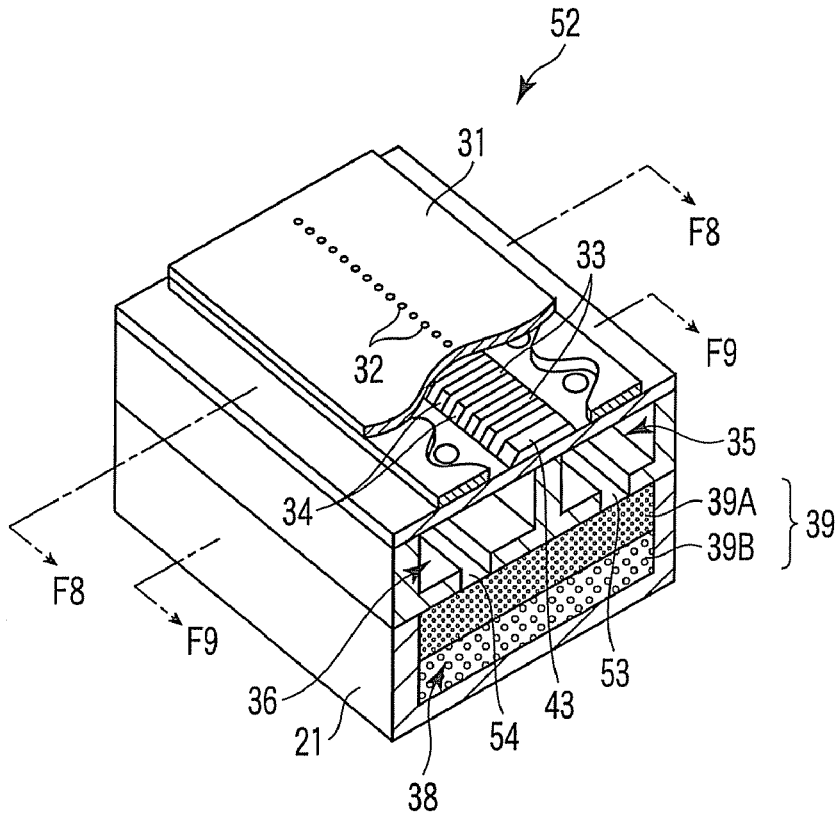
FIG. 7 is a perspective view of a head main body of an inkjet head illustrated in FIG. 6.
Figure 8:
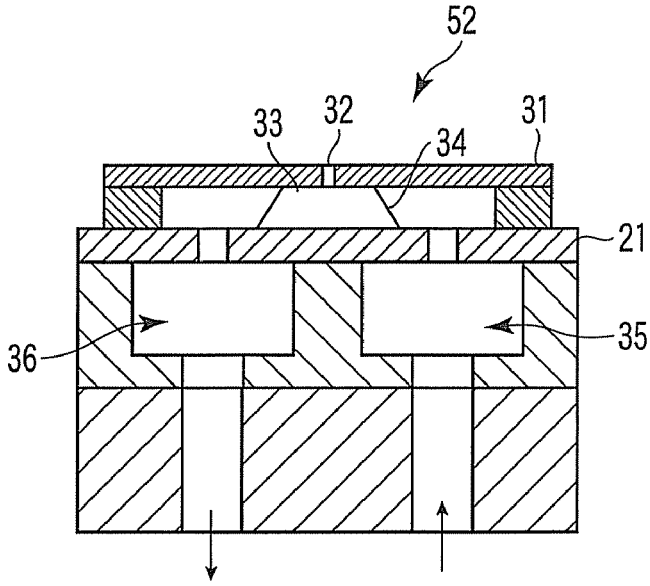
FIG. 8 is a cross-sectional view of the head main body illustrated in FIG. 7, taken along line F8-F8 of FIG. 7.

As illustrated in FIGS. 6 and 7, the head main body 21 has a nozzle plate 31, a plurality of nozzles 32 formed in the nozzle plate 31, pressure chambers 33 corresponding to the respective nozzles 32, drive elements 34 which are arranged on both sides of each pressure chamber 33 and hold each pressure chamber 33 therebetween, a supply channel 35 and a recovery channel 36 which communicate with the pressure chambers 33, a pressure-control liquid chamber 38 which is connected at one end to the supply channel 35 and the recovery channel 36 and opened at the other end to the atmosphere, a porous member 39 which is contained inside the pressure-control liquid chamber 38, a first communicating channel 53 which connects the supply channel 35 with the pressure-control liquid chamber 38, and a second communicating channel 54 which connects the recovery channel 36 with the pressure-control liquid chamber 38.

The nozzles 32 are formed in a line on the nozzle plate 31. The supply channel 35 is connected to the supply port 23, and can supply the liquid to the pressure chambers 33. The recovery channel 36 is connected to the recovery port 24, and can recover the liquid from the pressure chambers 33. The channel diameter and the length of the supply channel 35 are equal to the channel diameter and the length of the recovery channel 36. Further, the channel diameter and the length of the first communicating channel 53 are equal to the channel diameter and the length of the second communicating channel 54. Therefore, the channel resistance from the nozzles 32 to the first communicating channel 53 is equal to the channel resistance from the nozzles 32 to the second communicating channel 54. The term "supply section" in the claims indicates a concept including the supply port 23 and the supply channel 35. Further, the term "recovery section" in the claims indicates a concept including the recovery port 24 and the recovery channel 36.

The pressure-control liquid chamber 38 has an air release hole 46. The air release hole 46 is connected to the air release port 25. The porous member 39 is a spongy member which can absorb liquid and hold the liquid therein, and is formed of polyurethane foam or the like. The porous member 39 has a plurality of minute holes 40, which communicate with each other. The porous member 39 exhibits a capillary phenomenon for liquid.

Figure 9:
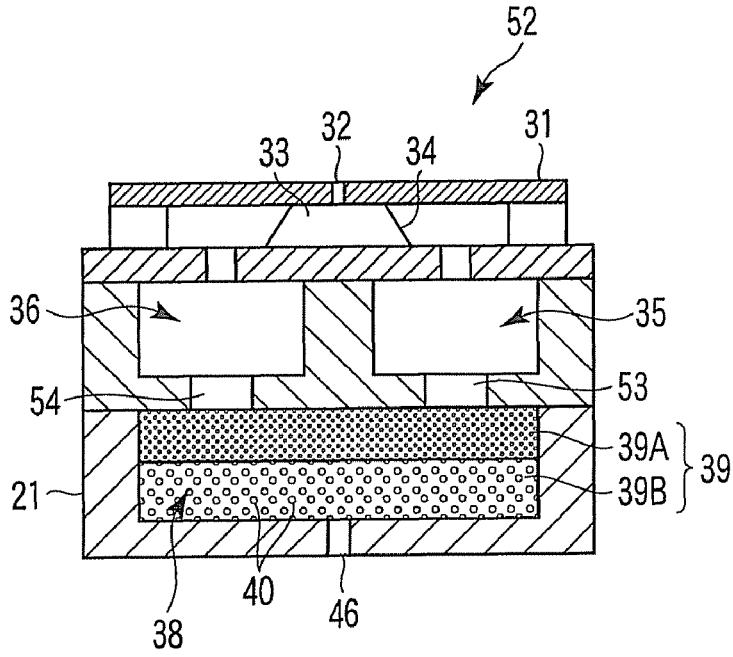
FIG. 9 is a cross-sectional view of the head main body illustrated in FIG. 7, taken along line F9-F9 of FIG. 7.

As illustrated in FIGS. 7 and 9, the porous member 39 has a first portion 39A which is densely formed, and a second portion 39B which is sparsely formed. The first portion 39A is disposed in a position adjacent to the first communicating channel 53 and the second communicating channel 54. The second portion 39B is disposed in a position adjacent to the air release hole 46. The first portion 39A is disposed under the second portion 39B.

To use the inkjet recording apparatus 51 having the above structure, first, the pump 17 is driven in the state where the air release valve 15 of the tank 13 is opened, and thereby the inkjet head 52 is filled with the liquid. Then, when a certain volume of liquid is filled in the porous member 39, filling of the liquid is stopped. In this state, the capillary action of the porous member 39 influences the pressure chambers 33, and the pressure of the pressure chambers 33 is controlled to a weak negative pressure which is suitable for liquid discharge.

Next, after the air release valve 15 is closed, the pump 17 is driven to circulate the liquid through the circulating channel 16. Also in this state where the liquid is circulated, the pressure chambers 33 in the vicinity of the nozzles 32 is maintained at a weak negative pressure by the capillary action of the porous member 39.

More specifically, when the pressure in the inkjet head 52 is about to fall, the amount of the liquid maintained inside the porous member 39 is reduced. In this case, the liquid level of the liquid impregnated in the porous member 39 lowers, and the liquid is maintained only by the dense first portion 39A of the porous member 39. In this state, the porous member 39 exhibits an intense capillary action, and functions to draw the liquid from the tank 13 and the circulating channel 16 into the porous member 39. Thereby, the pressure in the inkjet head 52 is increased, and an exhaustion of the liquid in the inkjet head 52 is prevented.

In addition, when the pressure in the inkjet head 52 is about to rise, the amount of the liquid impregnated into the porous member 39 increases, and the liquid level of the liquid rises. In this case, the liquid level of the liquid reaches the sparse second portion 39B. In this state, the porous member 39 exhibits a weak capillary action. As a result, the amount of the liquid drawn from the tank 13 into the inkjet head 52 is reduced, and the pressure in the inkjet head 52 can be maintained at a constant weak pressure.

In the state where the liquid is circulated, the pressure on the upstream side as viewed from the nozzles 32 is higher, and the pressure on the downstream side as viewed from the nozzles 32 is lower. However, since the channel resistance from the nozzles 32 to the first communicating channel 53 is equal to the channel resistance from the nozzles 32 to the second communicating channel 54, the pressure in the vicinity of the nozzles 32 can be set to the same state as that before the liquid is circulated.

According to the second embodiment, the inkjet recording apparatus 51 has the inkjet head 52, the tank 13 to supply the liquid to the inkjet head 52, and the circulation mechanism 14 which circulates the liquid between the inkjet head 52 and the tank 13. The inkjet head 52 has the nozzles 32 to discharge liquid droplets, the pressure chambers 33 which are configured to communicate with the respective nozzles 32 and filled with the liquid, the supply channel 35 which is configured to communicate with the pressure chambers 33 and supplies the liquid to the pressure chambers 33, the recovery channel 36 which is configured to communicate with the pressure chambers 33 and recovers the liquid from the pressure chambers 33, the pressure-control liquid chamber 38 which is connected at one end to the supply channel 35 and the recovery channel 36 and opened at the other end to the atmosphere, the porous member 39 which is contained inside the pressure-control liquid chamber 38, the first communicating channel 53 which connects the supply channel 35 with the pressure-control liquid chamber 38, and the second communicating channel 54 which connects the recovery channel 36 with the pressure-control liquid chamber 38. The channel resistance from the nozzles 32 to the first communicating channel 53 is equal to the channel resistance from the nozzles 32 to the second communicating channel 54.

According to the above structure, since there is provided the pressure-control liquid chamber 38 opened to the atmosphere, it is possible to maintain the inside of the inkjet head 52 at almost the atmospheric pressure. In addition, since the porous member 39 is disposed inside the pressure-control liquid chamber 38, it is possible to cause the capillary action to influence the liquid. Thereby, the liquid is drawn upward to cause the meniscuses of the nozzles 32 to recede, and the pressure in the vicinity of the nozzles 32 can be maintained at a weak negative pressure lower than the atmospheric pressure. Therefore, it is possible to maintain a suitable pressure for liquid discharge in the vicinity of the nozzles 32 of the inkjet head 52, regardless of the length of the pipe of the circulating channel 16, the diameter of the circulating channel 16, and the pressure of the tank 13.

Further, generally, in the case of providing a structure like the first communicating channel 53 and the second communicating channel 54, there occurs a phenomenon in the porous member 39 that the pressure on the upstream side is high and the pressure on the downstream side is low, when the liquid is circulated. However, according to the second embodiment, the channel resistance from the nozzles 32 to the first communicating channel 53 is equal to the channel resistance from the nozzles 32 to the second communicating channel 54. Therefore, even in the above structure provided with the first communicating channel 53 and the second communicating channel 54, it is possible to maintain a negative pressure similar to that in the state where the liquid is not circulated.

In this case, the porous member 39 has the first portion 39A which is densely formed, and the second portion 39B which is sparsely formed, and the first portion 39A is disposed under the second portion 39B. According to this structure, when the pressure is about to fall, the liquid is impregnated and held only in the first portion 39A. Therefore, an intense capillary action influences the liquid, and the liquid is drawn from the tank 13 and the circulating channel 16 into the inkjet head 52. This prevents scarcity of the liquid in the inkjet head 52.

On the other hand, when the liquid in the inkjet head 52 increases and the pressure is about to rise, the liquid is impregnated and held in both the first portion 39A and the second portion 39B of the porous member 39. In this case, a weak capillary action influences the liquid, and thus the amount of the liquid drawn from the tank 13 and the circulating channel 16 into the inkjet head 52 is reduced. This prevents supply of a large amount of liquid to the inkjet head 52, and rise of the pressure in the inkjet head 52.

Next, a third embodiment including an inkjet recording apparatus 61 is explained below with reference to FIG. 10. Although the inkjet recording apparatus 61 of the third embodiment is different from the first embodiment in the drive elements 34 and the number of nozzle lines of an inkjet head 62, the other constituent elements thereof are the same as those of the first embodiment. Therefore, constituent elements which are different from the first embodiment are mainly explained, and the same constituent elements as the first embodiment are denoted by the same respective reference numbers and not explained in the third embodiment.

The inkjet head 62 has a head main body 21, a pair of circuit boards 22 attached to the head main body 22, a supply port 23 to supply liquid to the head main body 21, a recovery port 24 to recover the liquid from the head main body 21, and an air release port 25 connected to the head main body 21.

Figure 10:
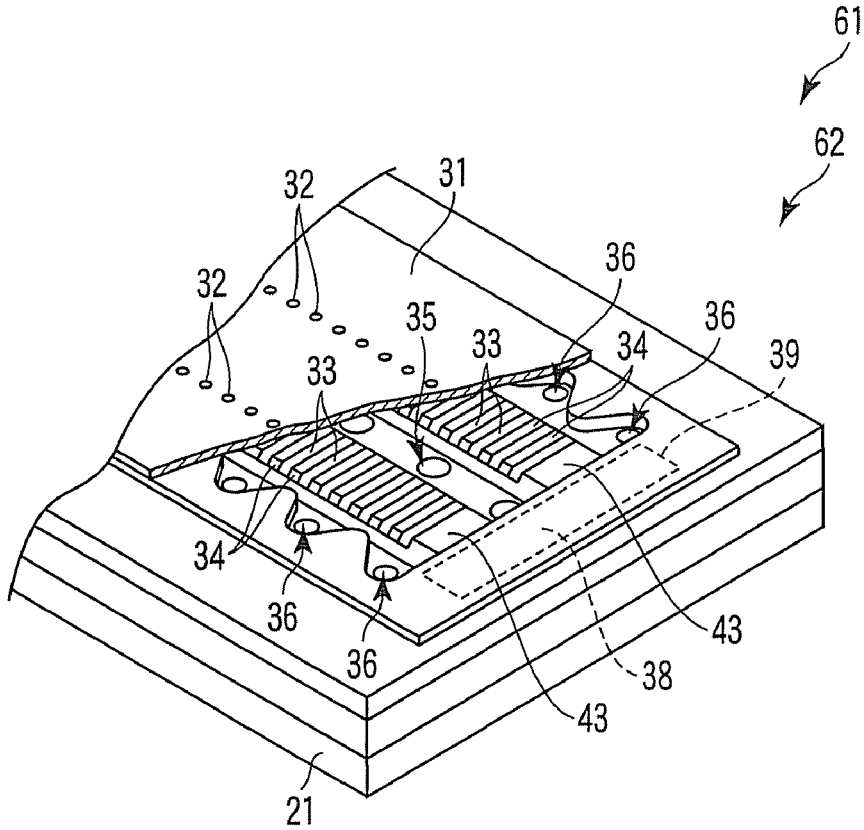
FIG. 10 is a perspective view of an inkjet head of an inkjet recording apparatus according to a third embodiment.

As illustrated in FIG. 10, the head main body 21 has a nozzle plate 31, a plurality of nozzles 32 formed in two lines on the nozzle plate 31, pressure chambers 33 formed in two lines in correspondence with the nozzles 32 formed in two lines, drive elements 34 which are arranged on both sides of each pressure chamber 33 and hold each pressure chamber 33 therebetween, supply channels 35 and recovery channels 36 which communicate with the pressure chambers 33, a bypass channel 37 which is independent of the pressure chambers 33 and connects the supply channels 35 with the recovery channels 36, a pressure-control liquid chamber 38 which is connected at one end to the bypass channel 37 and opened at the other end to the atmosphere, and a porous member 39 which is contained inside the pressure-control liquid chamber 38.

The nozzles 32 are formed in two lines on the nozzle plate 31. The pressure chambers 33 are formed of a plurality of groove portions which are formed in piezoelectric members 43 arranged in two lines.

The supply channels 35 are connected to the supply port 23, and can supply the liquid to the pressure chambers 33. The recovery channels 36 are connected to the recovery port 24, and can recover the liquid from the pressure chambers 33.

The bypass channel 37 is formed in a position close to the end portion of the inkjet head 62. An opening portion 37A to communicate with the pressure-control liquid chamber 38 is formed at the given point in the bypass channel 37. The pressure-control liquid chamber 38 has an air release hole 46.

The porous member 39 is a spongy member which can absorb liquid and hold the liquid therein. The porous member 39 is formed of polyurethane foam or the like. The porous member 39 has a plurality of minute holes 40, which communicate with each other. The porous member 39 exhibits a capillary phenomenon for liquid. The structure of the porous member 39 is the same as that in the first embodiment. Specifically, the porous member 39 has a first portion 39A which is densely formed, and a second portion 39B which is sparsely formed. The first portion 39A is disposed in a position adjacent to the bypass channel 37. The second portion 39B is disposed in a position adjacent to the air release hole 46. The first portion 39A is disposed under the second portion 39B.

In the inkjet recording apparatus 61 having the above structure, when the pressure in the inkjet head 62 is about to fall, the porous member 39 exhibits an intense capillary action in the same manner as the first embodiment, and functions to draw the liquid from the tank 13 and the circulating channel 16 into the porous member 39. Thereby, the pressure in the inkjet head 62 is increased, and exhaustion of the liquid in the inkjet head 62 is prevented. Further, the pressure in the inkjet head 62 is maintained at a constant weak negative pressure.

On the other hand, when the pressure in the inkjet head 62 is about to rise, the porous member 39 exhibits a weak capillary action in the same manner as the first embodiment. As a result, the amount of the liquid drawn from the tank 13 into the inkjet head 62 is reduced, and the pressure in the inkjet head 62 can be maintained at a constant weak negative pressure.

According to the third embodiment, even in the structure in which the nozzles 32 and the drive elements 34 are arranged in two lines, the pressure in the vicinity of the nozzles 32 can be maintained at a constant negative pressure, by the pressure-control liquid chamber 38 opened to the atmosphere and the porous member 39.

The present invention is not limited to the above embodiments, but can be carried out with various modifications as a matter of course, within a range not departing from the gist of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An inkjet head comprising:

a nozzle to discharge liquid droplets;

a pressure chamber which is configured to communicate with the nozzle and filled with liquid;

a supply section which is configured to communicate with the pressure chamber and supplies the liquid to the pressure chamber;

a recovery section which is configured to communicate with the pressure chamber and recovers the liquid from the pressure chamber;

a bypass channel which is independent of the pressure chamber and connects the supply section with the recovery section;

a pressure-control liquid chamber which is connected at one end to the bypass channel and connected at the other end to the atmosphere; and a porous member which is contained inside the pressure-control liquid chamber.

2. An inkjet head according to claim 1, wherein the porous member has a first portion which is densely formed, and a second portion which is sparsely formed, and the first portion is disposed under the second portion.

3. An inkjet head according to claim 2, further comprising:

a pair of drive elements which are arranged on respective sides of the pressure chamber and perform share mode deformation.

4. An inkjet head according to claim 3, wherein the porous member is formed of polyurethane foam.

5. The inkjet head according to claim 4, wherein the liquid is formed of ink which can form characters and images on recording media.

6. An inkjet head comprising:

a nozzle to discharge liquid droplets;

a pressure chamber which is configured to communicate with the nozzle and filled with liquid;

a supply section which is configured to communicate with the pressure chamber and supplies the liquid to the pressure chamber;

a recovery section which is configured to communicate with the pressure chamber and recovers the liquid from the pressure chamber;

a pressure-control liquid chamber which is connected at one end to the supply section and the recovery section and connected at the other end to the atmosphere;

a porous member which is contained inside the pressure-control liquid chamber;

a first communicating channel which connects the supply section with the pressure-control liquid chamber; and a second communicating channel which connects the recovery section with the pressure-control liquid chamber, wherein channel resistance from the nozzle to the first communicating channel is equal to channel resistance from the nozzle to the second communicating channel.

7. An inkjet head according to claim 6, wherein the porous member has a first portion which is densely formed, and a second portion which is sparsely formed, and the first portion is disposed under the second portion.

8. An inkjet head according to claim 7, further comprising:

a pair of drive elements which are arranged on respective sides of the pressure chamber and perform share mode deformation.

9. An inkjet head according to claim 8, wherein the porous member is formed of polyurethane foam.

10. An inkjet head according to claim 9, wherein the liquid is formed of ink which can form characters and images on recording media.

11. An inkjet recording apparatus comprising:

an inkjet head;

a tank to supply liquid to the inkjet head; and a circulation mechanism which circulates the liquid between the inkjet head and the tank, wherein the inkjet head includes:

a nozzle to discharge liquid droplets;

a pressure chamber which is configured to communicate with the nozzle and filled with the liquid;

a supply section which is configured to communicate with the pressure chamber and supplies the liquid to the pressure chamber;

a recovery section which is configured to communicate with the pressure chamber and recovers the liquid from the pressure chamber;

a bypass channel which is independent of the pressure chamber and connects the supply section with the recovery section;

a pressure-control liquid chamber which is connected at one end to the bypass channel and connected at the other end to the atmosphere; and a porous member which is contained inside the pressure-control liquid chamber.

12. An inkjet recording apparatus according to claim 11, wherein the porous member has a first portion which is densely formed, and a second portion which is sparsely formed, and the first portion is disposed under the second portion.

13. An inkjet recording apparatus according to claim 12, further comprising:

a pair of drive elements which are arranged on respective sides of the pressure chamber and perform share mode deformation.

14. An inkjet recording apparatus according to claim 13, wherein the porous member is formed of polyurethane foam.

15. An inkjet recording apparatus according to claim 14, wherein the liquid is formed of ink which can form characters and images on recording media.

* * * * *